US009003781B2

(12) United States Patent
Murphy

(10) Patent No.: US 9,003,781 B2
(45) Date of Patent: Apr. 14, 2015

(54) PRE-TURBOCHARGER CATALYST

(71) Applicant: Ford Global Technologies, LLC, Dearborn, MI (US)

(72) Inventor: Patrick Murphy, Loughton (GB)

(73) Assignee: Ford Global Technologies, LLC, Dearborn, MI (US)

( * ) Notice: Subject to any disclaimer, the term of this patent is extended or adjusted under 35 U.S.C. 154(b) by 142 days.

(21) Appl. No.: 13/749,562

(22) Filed: Jan. 24, 2013

(65) Prior Publication Data

US 2014/0202140 A1 Jul. 24, 2014

(51) Int. Cl.
*F01N 3/10* (2006.01)

(52) U.S. Cl.
CPC ..... *F01N 3/10* (2013.01)

(58) Field of Classification Search
CPC ..... F01N 13/02; F01N 13/14; F01N 3/2885; F01N 3/28; F01N 3/2892; F02B 37/18; F02B 37/00; F02B 3/06; F02M 25/0707
USPC ..... 60/280, 299, 597
See application file for complete search history.

(56) References Cited

U.S. PATENT DOCUMENTS 4,122,673 A * 10/1978 Leins ..... 60/274
4,185,459 A * 1/1980 Holste ..... 60/280
6,422,008 B2 7/2002 Voss et al.
2006/0123775 A1 6/2006 Ellenberger et al.
2008/0010986 A1* 1/2008 Fuhrmann et al. ..... 60/598
2011/0023482 A1* 2/2011 Styles et al. ..... 60/605.2
2011/0113774 A1* 5/2011 Nunn et al. ..... 60/605.1
2011/0258990 A1* 10/2011 Tsujimoto et al. ..... 60/286
2013/0251512 A1* 9/2013 Lombard et al. ..... 415/125
2013/0315718 A1* 11/2013 Parker et al. ..... 415/157

FOREIGN PATENT DOCUMENTS

DE 102008034215 A1 * 1/2010 ..... F02M 25/07

OTHER PUBLICATIONS

Machine Translation of DE 102008034215, Machine Translated on Aug. 7, 2014.*

Konieczny, R. et al., "Pre-Turbocharger-Catalyst—Catalystic Performances on an Euro V Type Diesel Engine and Robust Design Development," SAE Technical Paper Series No. 2008-01-0768, SAE World Congress, Detroit, MI., Apr. 14-17, 2008, 13 pages.

* cited by examiner

*Primary Examiner* — Jason Shanske
*Assistant Examiner* — Patrick Maines
(74) *Attorney, Agent, or Firm* — Ivan Rogers; Alleman Hall McCoy Russell & Tuttle LLP

(57) ABSTRACT

Embodiments of a pre-turbo catalyst positioned within a turbine in a turbocharger of an engine are disclosed. In one example approach, a turbocharger for an engine comprises a turbine and a catalyst substrate mounted directly within the turbine.

14 Claims, 4 Drawing Sheets

PRE-TURBOCHARGER CATALYST

BACKGROUND AND SUMMARY

Diesel vehicles may be equipped with aftertreatment systems which may include, for example, selective catalytic reduction (SCR) systems, diesel oxidation catalysts (DOC), and diesel particulate filters in order to reduce emissions. In some examples, turbocharged engines may include pre-turbocharger catalysts, e.g., a diesel oxidation catalyst, in the exhaust system at a position upstream of a turbine in the turbocharger system. Such a pre-turbo catalyst may attain its operating temperature, e.g., light-off temperature, more quickly than downstream catalysts and may extract little energy from the exhaust gas thereby interfering minimally with supplying exhaust energy directly to the turbine section of a turbocharger. Pre-turbo metallic catalysts may include two parts—the substrate and the mantle. The substrate, on which the reactive agent (washcoat) resides, may be made from very thin steel that is held by an outer casing of thicker steel (the mantle).

The inventors herein have recognized that, in some examples, it may be advantageous to mount a pre-turbo catalyst in a turbocharger, e.g., in a throat of a turbine in the turbocharger. However, mounting pre-turbo catalysts in a turbocharger may be difficult as the turbine scroll is usually as-cast. This means that a gap may need to be maintained between the mantle of the pre-turbo catalyst and the housing of turbine in order to reduce vibrations between the mantle and the turbine housing. Such vibrations may lead to degradation of the pre-turbo catalyst, e.g., the mantle may crack. However, since the mantle may change shape due to thermal loading, this gap may be difficult to maintain, resulting in vibrations between the mantle and the turbine housing and component degradation.

In one example approach, in order to address these issues, a turbocharger for an engine comprises a turbine and a catalyst substrate mounted directly within the turbine.

In this way, the mantle mounting may be removed from the pre-turbo catalyst and instead the substrate may be mounted directly into a pre-machined turbine housing. Because the substrate is spring-like in nature, it may better accommodate the changing shape of the turbine housing than a rigidly mounted version with a mantle. For example, the substrate could be mounted against a machined edge of the turbine or possibly even as-cast depending on process variation and clamped using a turbine/manifold gasket. Deleting the external mounting of the pre-turbo catalyst allows the substrate to flex with the turbine housing, thus reducing unwanted component vibration and degradation.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
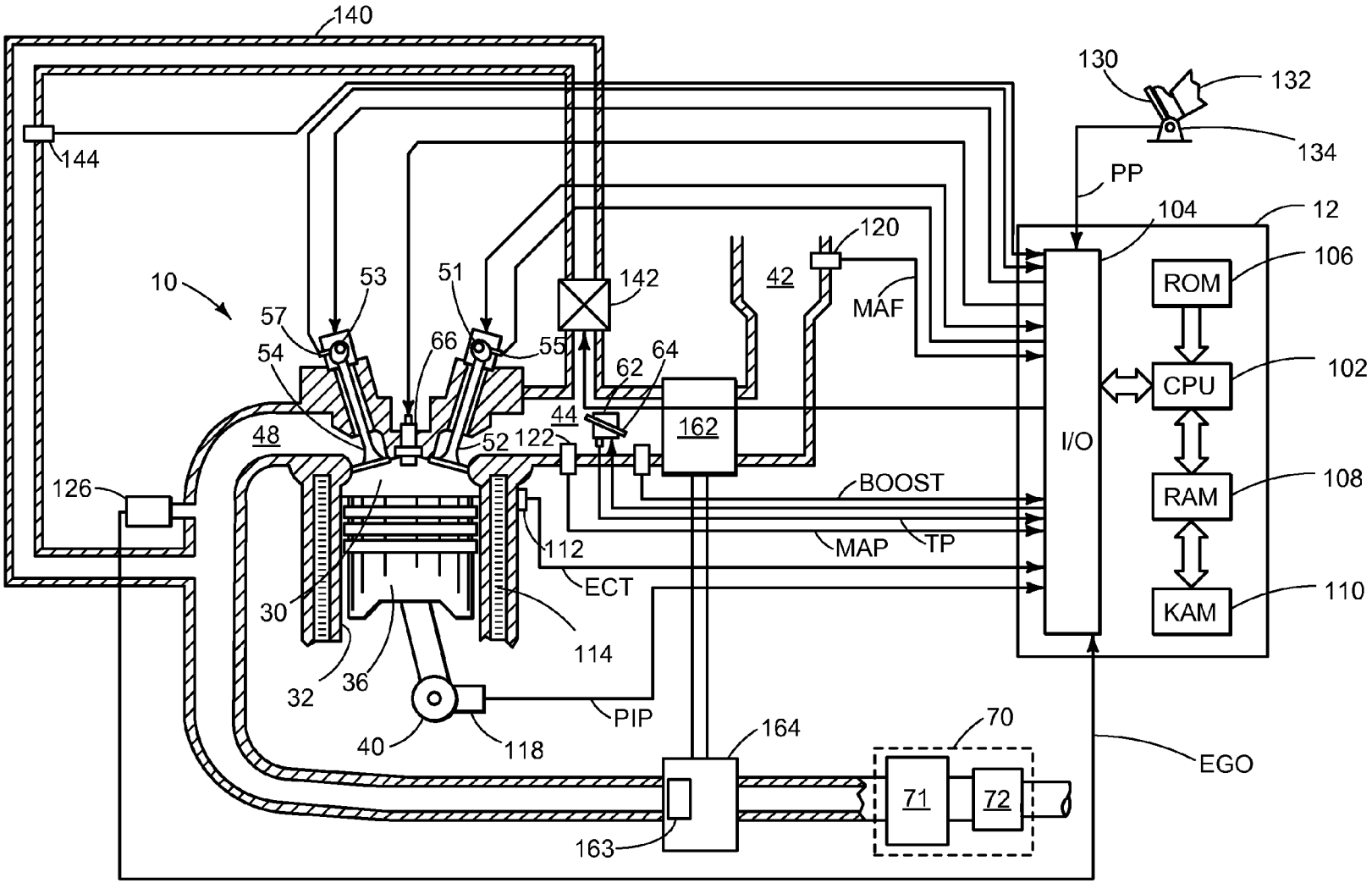
FIG. 1 shows a schematic diagram of an engine including a pre-turbo catalyst.
Figure 2:
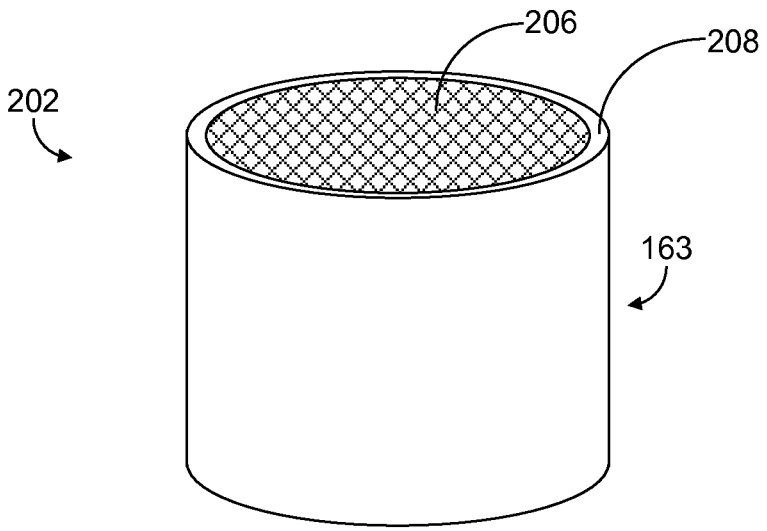
FIG. 2 shows example pre-turbo catalysts.
Figure 2:
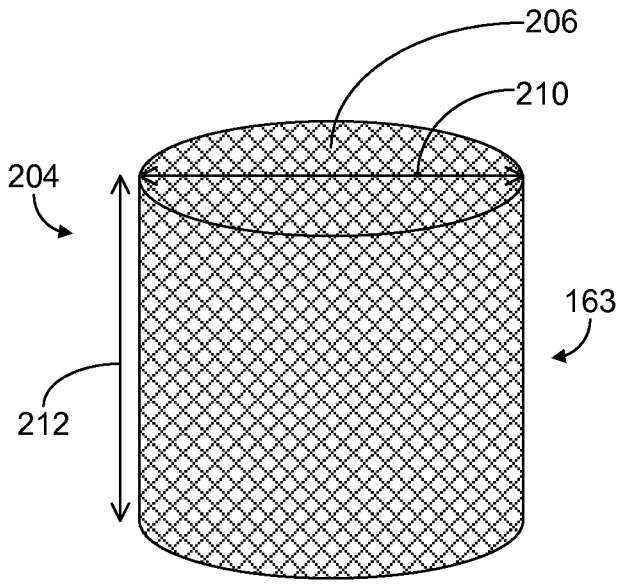
Figure 3:
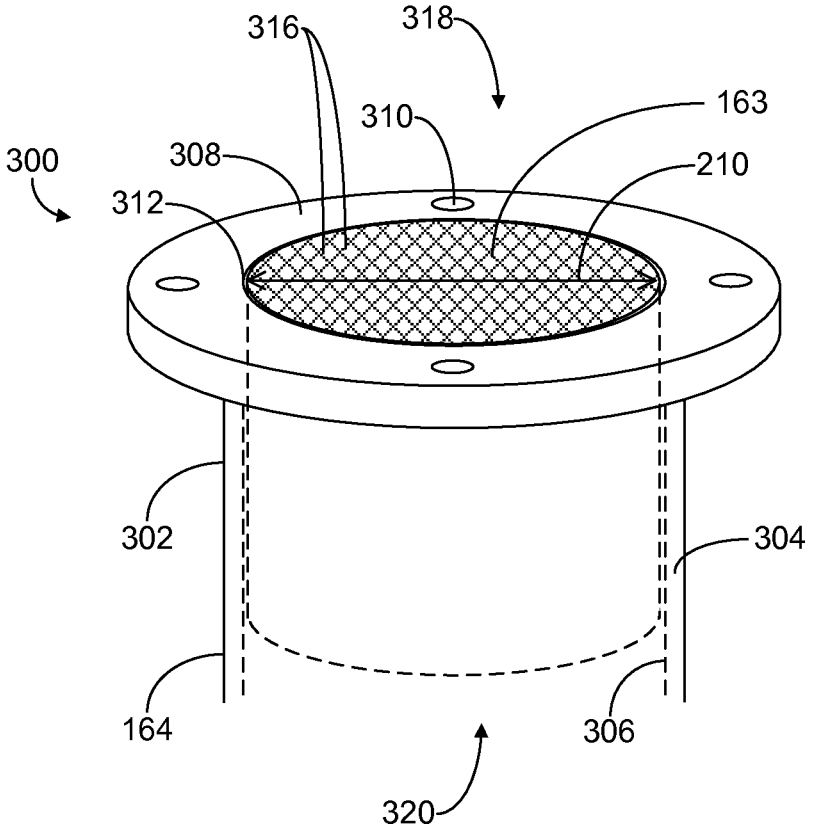
FIGS. 3 and 4 show examples of a pre-turbo catalyst substrate mounted directly within a turbine.
Figure 4:
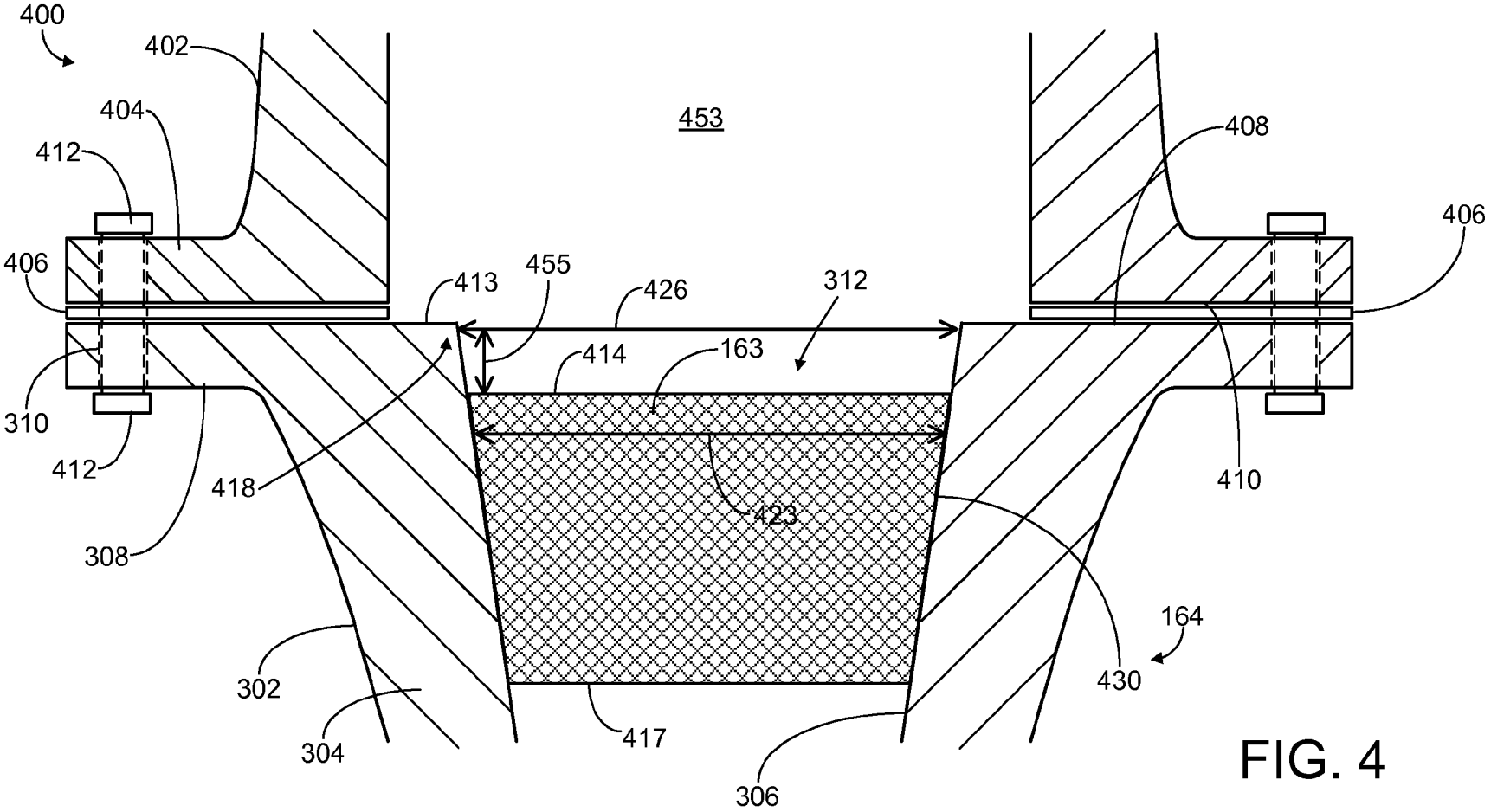

The following description relates to a pre-turbo catalyst included in a turbocharged engine, such as the engine shown in FIG. 1. As shown in FIG. 2, a mantle mounting of a pre-turbo catalyst may be removed so that only the substrate of the pre-turbo catalyst may be directly mounted within a turbine of a turbocharger. Examples of a pre-turbo catalyst substrate mounted directly within a throat of a turbine are shown in FIGS. 3 and 4.

FIG. 1 shows a schematic diagram showing one cylinder of multi-cylinder engine 10, which may be included in a propulsion system of an automobile. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP. Combustion chamber (i.e., cylinder) 30 of engine 10 may include combustion chamber walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system. Further, a starter motor may be coupled to crankshaft 40 via a flywheel to enable a starting operation of engine 10.

Combustion chamber 30 may receive intake air from intake manifold 44 via intake passage 42 and may exhaust combustion gases via exhaust passage 48. Intake manifold 44 and exhaust passage 48 can selectively communicate with combustion chamber 30 via respective intake valve 52 and exhaust valve 54. In some embodiments, combustion chamber 30 may include two or more intake valves and/or two or more exhaust valves.

In this example, intake valve 52 and exhaust valves 54 may be controlled by cam actuation via respective cam actuation systems 51 and 53. Cam actuation systems 51 and 53 may each include one or more cams and may utilize one or more of cam profile switching (CPS), variable cam timing (VCT), variable valve timing (VVT) and/or variable valve lift (VVL) systems that may be operated by controller 12 to vary valve operation. The position of intake valve 52 and exhaust valve 54 may be determined by position sensors 55 and 57, respectively. In alternative embodiments, intake valve 52 and/or exhaust valve 54 may be controlled by electric valve actuation. For example, cylinder 30 may alternatively include an intake valve controlled via electric valve actuation and an exhaust valve controlled via cam actuation including CPS and/or VCT systems. Fuel injector 66 is shown coupled directly to combustion chamber 30 for injecting fuel directly therein. Fuel injection may be via a common rail system, or other such diesel fuel injection system. Fuel may be delivered to fuel injector 66 by a high pressure fuel system (not shown) including a fuel tank, a fuel pump, and a fuel rail.

Intake passage 42 may include a throttle 62 having a throttle plate 64. In this particular example, the position of throttle plate 64 may be varied by controller 12 via a signal provided to an electric motor or actuator included with throttle 62, a configuration that is commonly referred to as electronic throttle control (ETC). In this manner, throttle 62 may be operated to vary the intake air provided to combustion chamber 30 among other engine cylinders. The position of throttle plate 64 may be provided to controller 12 by throttle position signal TP. Intake passage 42 may include a mass air flow sensor 120 and a manifold air pressure sensor 122 for providing respective signals MAF and MAP to controller 12.

Further, an exhaust gas recirculation (EGR) system may route a desired portion of exhaust gas from exhaust passage 48 to intake passage 42 via EGR passage 140. The amount of EGR provided to intake passage 42 may be varied by controller 12 via EGR valve 142. Further, an EGR sensor 144 may be arranged within the EGR passage and may provide an indication of one or more pressure, temperature, and concentration of the exhaust gas. Alternatively, the EGR may be controlled through a calculated value based on signals from the MAF sensor (upstream), MAP (intake manifold), IAT (intake manifold gas temperature) and the crank speed sensor. Further, the EGR may be controlled based on an exhaust O2 sensor and/or an intake oxygen sensor (intake manifold)]. Under some conditions, the EGR system may be used to regulate the temperature of the air and fuel mixture within the combustion chamber. While FIG. 1 shows a high pressure EGR system, additionally, or alternatively, a low pressure EGR system may be used where EGR is routed from downstream of a turbine of a turbocharger to upstream of a compressor of the turbocharger.

As such, engine 10 may further include a compression device such as a turbocharger or supercharger including at least a compressor 162 arranged along intake manifold 44. For a turbocharger, compressor 162 may be at least partially driven by a turbine 164 (e.g., via a shaft) arranged along exhaust passage 48. For a supercharger, compressor 162 may be at least partially driven by the engine and/or an electric machine, and may not include a turbine. Thus, the amount of compression provided to one or more cylinders of the engine via a turbocharger or supercharger may be varied by controller 12.

Exhaust gas sensor 126 is shown coupled to exhaust passage 48 upstream of emission control system 70. Sensor 126 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a NOx, HC, or CO sensor.

Emission control system 70 is shown arranged along exhaust passage 48 downstream of exhaust gas sensor 126. System 70 may be a selective catalytic reduction (SCR) system, a three way catalyst (TWC), $NO_x$ trap, a diesel oxidation catalyst (DOC), and various other emission control devices, or combinations thereof. For example, device 70 may be a diesel aftertreatment system which includes an SCR catalyst 71 and a particulate filter (PF) 72. In some embodiments, PF 72 may be located downstream of the catalyst (as shown in FIG. 1), while in other embodiments, PF 72 may be positioned upstream of the catalyst (not shown in FIG. 1).

In one example, a urea injection system may be provided to inject liquid urea to SCR catalyst 71. However, various alternative approaches may be used, such as solid urea pellets that generate an ammonia vapor, which is then injected or metered to SCR catalyst 71. In still another example, a lean $NO_x$ trap may be positioned upstream of SCR catalyst 71 to generate ammonia for the SCR catalyst, depending on the degree or richness of the air-fuel ratio fed to the Lean NOx trap.

Further, engine 10 may include a pre-turbo catalyst 163. As described in more detail below, pre-turbo catalyst 163 may not include any external mounting or outer casings, e.g., pre-turbo catalyst 163 may not include a mantle mounting, and instead may comprise only a pre-turbo catalyst substrate which is mounted directly within turbine 164. The pre-turbo catalyst substrate may be composed of a metal material, e.g., steel, and may include a washcoat or reactive agent disposed thereon. As remarked above, such pre-turbo catalyst may have a quicker light-off temperature than catalysts positioned downstream of turbine 164.

Controller 12 is shown in FIG. 1 as a microcomputer, including microprocessor unit 102, input/output ports 104, an electronic storage medium for executable programs and calibration values shown as read only memory chip 106 in this particular example, random access memory 108, keep alive memory 110, and a data bus. Controller 12 may receive various signals from sensors coupled to engine 10, in addition to those signals previously discussed, including measurement of inducted mass air flow (MAF) from mass air flow sensor 120; engine coolant temperature (ECT) from temperature sensor 112 coupled to cooling sleeve 114; a profile ignition pickup signal (PIP) from Hall effect sensor 118 (or other type) coupled to crankshaft 40; throttle position (TP) from a throttle position sensor; and absolute manifold pressure signal, MAP, from sensor 122. Engine speed signal, RPM, may be generated by controller 12 from signal PIP. Manifold pressure signal MAP from a manifold pressure sensor may be used to provide an indication of vacuum, or pressure, in the intake manifold. In one example, sensor 118, which is also used as an engine speed sensor, may produce a predetermined number of equally spaced pulses every revolution of the crankshaft.

Storage medium read-only memory 106 can be programmed with computer readable data representing instructions executable by processor 102 for performing the methods described below as well as other variants that are anticipated but not specifically listed.

As described above, FIG. 1 shows only one cylinder of a multi-cylinder engine, and each cylinder may similarly include its own set of intake/exhaust valves, fuel injector, spark plug, etc.

FIG. 2 shows example pre-turbo catalysts 163 which may be included in an exhaust system of an engine. For example, at 202, FIG. 2 shows a pre-turbo catalyst 163 with a substrate 206 mounted within an outer casing or mantle 208. As remarked above, the substrate, on which the reactive agent (washcoat) resides, may be made from very thin steel or other metal and this may be held by an outer casing of thicker metal which is called the mantle. However, by including such an outer casing 208 around the catalyst substrate 206 in applications where the pre-turbo catalyst is mounted within the turbine, vibration may occur between the mantle 208 and the housing of the turbine leading to degradation of the pre-turbo catalyst. Also, due to low-cycle fatigue, the substrate may crack. The low-cycle fatigue is a result of the weld/braize or other attachment of the substrate to the mantle and the subsequent constraint between the mantle and the substrate. This constraint may cause plastic strain during heat up/cool down conditions.

Thus, as shown at 204 in FIG. 4, a pre-turbo catalyst may not include any external casing or mantle and may instead comprise only the substrate 206 which may be mounted directly within an interior of a portion of the turbine as shown in FIGS. 3 and 4 described below. Such a non-mantle catalyst may more easily cope with the minute shape changes that a turbine casting experiences during its lifetime.

The substrate in pre-turbo catalyst 163 may have a variety of shapes and may be shaped and sized to substantially conform to an inlet of a turbine. In one example, as shown at 204 in FIG. 2, pre-turbo catalyst 163 may have a cylindrical shape with a height 212 and a diameter 210. Here, for example, the diameter 210 may be chosen to be substantially the same as a diameter of an inlet of a turbine within which is will be mounted. However, in some examples, the diameter 210 may exceed the turbine diameter and may be required to twist/compress to fit within the turbine inlet so that an interference fitting is formed when the catalyst is in an installed position within inlet 312 of the turbine. For example, in an un-installed position the diameter 210 of the catalyst 163 may be greater than a diameter of the inlet 312 of turbine 164.

For example, as shown in FIG. 3, a pre-turbo catalyst 163 which does not include a mantle or any outer casings and instead only comprises the catalyst substrate, may be mounted directly within a throat 302 of a turbine 164. For example, turbine throat 302 may be an inlet portion of turbine 164 which is upstream of the turbine wheel or spools contained in the turbine. Turbine throat 302 includes walls 304 and a coupling region 308 adjacent to inlet 312 of the turbine. For example, coupling region 308 may be configured to form a coupling interface with an exhaust manifold, e.g., exhaust manifold 48, of an engine and may include orifices 310 configured to receive bolts or other hardware for coupling the throat 302 to an exhaust manifold. For example, coupling region 308 may be a flange or lip extending around inlet 312 of turbine 164. Here, the diameter 210 of the pre-turbo catalyst 163 is substantially the same length as a diameter of an inlet 312 of the turbine throat so that the substrate of catalyst 163 is mounted directly against inner walls 306 of the throat 302 of the turbine 164.

Pre-turbo catalyst 163 may comprise a catalyst substrate brick or monolith which includes a plurality of passages 316 therethrough. Each passage in the plurality of passages 316 through the substrate brick may extend from an opening in the top end 318 of catalyst 163 to an opening in the bottom end 320 of catalyst 163 in a direction substantially parallel to wall 304 of turbine throat 302. Further, each passage in the plurality of passages 316 may include a catalyst coating through a length of the passage. The catalyst brick 163 may fully fill the interior space within turbine inlet 312 in a region adjacent to a top side 318 of the turbine throat 302. As such, catalyst 163 forms a monolithic structure extending throughout the entire inlet 312 so that exhaust gas entering turbine 164 passes through one or more passages within catalyst 163.

FIG. 4 shows an example coupling 400 of a turbine throat 302 including a pre-turbo catalyst 163 disposed therein with a conduit 402 coupled to an exhaust source 453 of an engine. For example, conduit 402 may be an exhaust conduit coupled to exhaust manifold 48 or may be an exhaust conduit coupled a cylinder head of the engine. As remarked above, pre-turbo catalyst 163 lacks a mantle or other external mounting component, such as an outer casing, and instead only comprises a catalyst substrate. As shown in FIG. 4, a catalyst without a mantle may be mounted as an interference fit only in the throat of the turbine.

As remarked above, turbine 164 includes a lip or flange 308 adjacent to inlet 312 of turbine throat 302. Likewise, exhaust conduit 402 includes a flange region 404 configured to form a coupling interface between the exhaust manifold or a cylinder head of the engine and the turbine 164. Coupling 400 may further include a gasket 406 positioned between a bottom surface 410 of flange 404 and a top surface 408 of turbine flange 308 to seal the coupling. Both flange 308 and flange 404 may include a plurality of orifices 310 configured to receive bolts 412 or other hardware to couple the exhaust manifold to the turbine inlet at the interface.

Catalyst substrate 163 may be fixedly coupled within inlet 312 of turbine throat 302 in a variety of ways. In one example, substrate 163 may be installed within turbine inlet 312 via an interference fit against interior walls 306 of the throat 302 of turbine 164. For example, as remarked above, a diameter 210 of substrate block 163 may be larger than a diameter 426 of turbine inlet 312 so that substrate block 163 may be compressed and/or twisted to form an interference fit directly against inner walls 306 of turbine inlet 312. As such, the substrate 163 may be mounted directly against the interior walls 306 of turbine throat 302 so that no gap is present between an outer diameter 430 of substrate 163 and the interior walls 306 of turbine throat 312 and the substrate is in physical contact with the inner walls of the turbine inlet. Further, the substrate may extend throughout the interior of inlet 312.

In some examples, a top surface 414 of substrate brick 163 may be positioned a distance 455 below a top surface 413 at an edge 418 of inlet 312 of turbine throat 302. However, in other examples, top surface 414 may be substantially flush with a top surface 413 at an edge 418 of inlet 312 of turbine throat 302. Further, in some examples, diameter 426 of inlet 312 may decrease in a direction from exhaust conduit 402 towards turbine 164 so that, in an installed position, a diameter 423 of catalyst brick 163 may also decrease in a direction from top surface 414 towards a bottom surface 417 of substrate brick 163. However, in other examples, diameter 426 may be substantially constant throughout a region of turbine throat 302 so that diameter 423 of substrate 163 is substantially constant throughout a length of the substrate in an installed position. In an installed position, the catalyst brick 163 extends fully throughout an entire interior of turbine 164 in a region of turbine inlet 312 so that gases entering turbine 164 pass through one or more passages in the substrate.

It will be appreciated that the configurations disclosed herein are exemplary in nature, and that these specific embodiments are not to be considered in a limiting sense, because numerous variations are possible. For example, the above technology can be applied to V-6,I-4, I-6, V-12, opposed 4, and other engine types. The subject matter of the present disclosure includes all novel and nonobvious combinations and subcombinations of the various systems and configurations, and other features, functions, and/or properties disclosed herein.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application.

Such claims, whether broader, narrower, equal, or different in scope to the original claims, also are regarded as included within the subject matter of the present disclosure.

The invention claimed is:

1. A turbocharger for an engine, comprising:

a turbine; and a catalyst substrate brick mounted directly within an inlet of the turbine, wherein a top surface of the catalyst substrate brick is positioned in the inlet a distance below an edge of a throat of the turbine at a coupling interface of the turbine with an exhaust manifold of the engine.

2. The turbocharger of claim 1, wherein the catalyst substrate brick is mounted in a throat of the turbine adjacent to a coupling interface of the turbine with an exhaust manifold of the engine.

3. The turbocharger of claim 1, wherein the catalyst substrate brick is mounted directly against inner walls of the throat of the turbine and extends across the inlet of the turbine.

4. The turbocharger of claim 1, wherein the catalyst substrate brick does not include an outer casing.

5. The turbocharger of claim 1, wherein the catalyst substrate brick is mounted within the inlet via an interference fitting against interior walls of the inlet.

6. The turbocharger of claim 1, wherein, in an un-installed position, a diameter of the catalyst substrate brick is greater than a diameter of the inlet.

7. The turbocharger of claim 1, wherein a diameter of the catalyst substrate brick is constant throughout a length of the brick.

8. The turbocharger of claim 1, wherein the catalyst substrate brick includes a plurality of passages parallel to inner walls of the inlet.

9. A turbocharger for an engine, comprising:

a turbine; and a catalyst substrate brick mounted directly within an inlet of the turbine, wherein a diameter of the catalyst substrate brick decreases in a direction from a coupling interface of the turbine with an exhaust manifold of the engine towards the turbine.

10. A turbocharger for an engine, comprising:

a turbine; and a pre-turbine catalyst substrate disposed in the turbine, the catalyst lacking a mantle and held in place via in interference fitting against interior walls of the turbine, wherein a top surface of the catalyst substrate is positioned in an inlet of the turbine a distance below an edge of a throat of the turbine at a coupling interface of the turbine with an exhaust source of the engine.

11. The turbocharger of claim 10, wherein the catalyst substrate is mounted directly within a throat of the turbine against inner walls of the throat.

12. The turbocharger of claim 10, wherein, in an un-installed position, a diameter of the catalyst substrate is greater than a diameter of an inlet of the turbine.

13. The turbocharger of claim 10, wherein a diameter of the catalyst substrate decreases in a direction from a coupling interface of the turbine with an exhaust source of the engine towards the turbine.

14. The turbocharger of claim 10, wherein a diameter of the catalyst substrate is constant throughout a length of the substrate.

* * * * *